United States Patent [19]

Keene

[11] 3,970,201

[45] July 20, 1976

[54] BOTTLE GRIPPER

[75] Inventor: Harold J. Keene, Milwaukee, Wis.

[73] Assignee: Stowell Industries Inc., Milwaukee, Wis.

[22] Filed: June 23, 1975

[21] Appl. No.: 589,144

[52] U.S. Cl. ..... 214/1 BT; 214/309; 294/64 R

[51] Int. Cl.[2] ..... B65G 47/00

[58] Field of Search ..... 214/1 B, 1 BS, 1 BB, 214/1 BT, 1 BH, 1 BV, 309; 294/64 R, 64 A, 64 B, 65; 198/20 R

[56] References Cited

UNITED STATES PATENTS

| | | | |
|---|---|---|---|
| 2,695,190 | 11/1954 | Meierjohan | 214/1 BT X |
| 2,863,579 | 12/1958 | Meyer | 214/1 BB X |
| 2,873,996 | 2/1959 | McHugh, Jr. | 214/309 X |
| 3,311,400 | 3/1967 | Rowekamp | 214/309 X |
| 3,637,249 | 1/1972 | Kuhl et al. | 294/64 R |

*Primary Examiner*—Frank E. Werner

*Attorney, Agent, or Firm*—Michael, Best & Friedrich

[57] ABSTRACT

The metal stem of the gripper head assembly incorporates a flexible rubber section which permits limited movement of the gripper to align the gripper with the bottle while any necessary or desirable vertical movement is accommodated by vertical movement of the metal stem against the bias of the spring. The flexibility afforded by the rubber is adequate for self-alignment purposes but is not great enough to allow pendulation or swinging of the bottles during horizontal transport.

3 Claims, 3 Drawing Figures

BOTTLE GRIPPER

BACKGROUND OF THE INVENTION

In bottling plants the cases of empty bottles are positioned under gripper assemblies which then descend to engage and pick up the neck of each bottle in the case. The bottles are then lifted out of the case and moved horizontally to be lowered onto a conveyor feeding into a bottle washing machine. The bottles are not always precisely located within the case or the case itself may be slightly out of position. In either case the descending gripper assembly may be misaligned with one or more bottles in the case. If the misalignment is severe there should be some way to accommodate vertical movement of a gripper relative to the descending gripper assembly to thereby avoid breakage of the bottle. If the entry to the gripper assembly is slightly flared, the flare will accommodate some misalignment by way of forcing the bottle to move into alignment with the gripper. U.S. Pat. No. 2,695,190 shows a gripper assembly in which the stem supporting the gripper is a flexible hose which, of course, can bend and move sideways to accommodate greater misalignment than a rigid stem can tolerate. But that construction becomes unusable with the modern machines requiring more rapid cycling and, hence, rapid acceleration and deceleration during the horizontal movement. Thus the long flexible stems allowed swinging or pendulation of the bottles with consequent breakage. Furthermore, that construction did not permit any vertical movement and if the misalignment was beyond that which could be accommodated by the flexible stem, breakage could be the result.

SUMMARY OF THE INVENTION

The present construction achieves two goals. It permits vertical movement of the gripper relative to the gripper assembly and incorporates a short flexible section of rubber having a durometer which permits enough flexing for self-alignment purposes while being stiff enough to resist swinging or pendulation, thus permitting the duty cycle to be shortened.

DESCRIPTION OF THE PREFERRED EMBODIMENT

Figure 1:
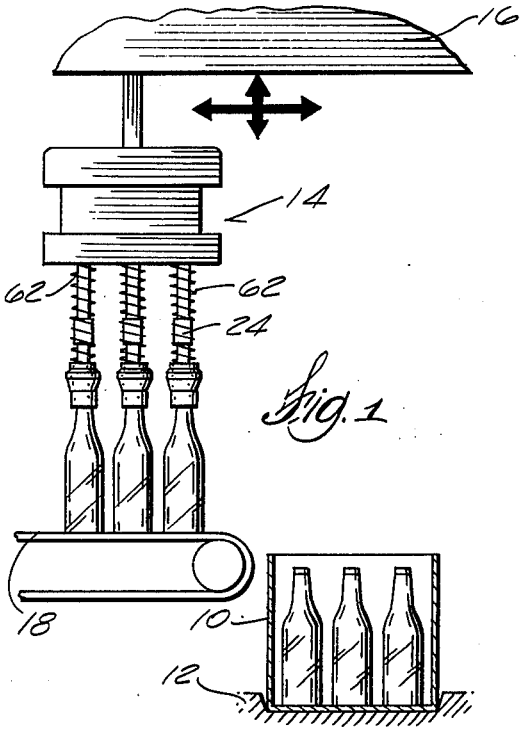
FIG. 1 is a schematic view giving environment of the gripper assembly and its use.

The empty bottles in cases 10 are positioned on a conveyor or other means 12 and the gripper assembly 14 is mounted in a suitable support 16 for horizontal movement between a position in which it overlies the infeed conveyor 18 which transports bottles into a bottle washing machine or another position in which it overlies the case 10. The gripper assembly includes a support 20 in which each gripper stem 22 is mounted for vertical movement relative to the support 20. The lower limit of motion of the stem 22 is determined by the O-ring 23 engaging the top of support 20. About two-thirds of the way down the stem there is a rubber section 24 which is bonded to upper stem 22 and to lower stem 26. Bearing sleeve 28 is mounted on the reduced diameter section at the bottom of the lower stem 26 and the retaining nut 30 holds the hub portion of the plastic gripper 32 tight between the nut and the bottom of the bearing sleeve 28. The stem assembly is provided with a bore 34 leading to cross hole 36 at the bottom of the bore. Hole 36 communicates with the groove 38 in the lower end of stem 26. Sleeve 28 is provided with a multiplicity of holes 40 leading to the recess 42 in the plastic gripper. This construction allows pressure to be applied through the bore to the chamber 44 between the plastic gripper and cap 46 which is slidable on the outside of the sleeve. The cap 46 is mounted on the sleeve and is provided with a sliding seal 48. A cylindrical member 50 is fixed on the cap 46 and moves with the cap. Accordingly, the gripper 32 is provided with a sliding seal 52 to prevent leakage between the gripper and member 50. Thus leakage from chamber 44 is minimal and of no consequence.

The inside of the cylindrical member 50 is provided with cam surfaces 54. When the pressure in chamber 44 is increased, the cap and cylinder slide upwardly and pull the cam surfaces 54 against the depending plastic gripper fingers 56 to move them into engagement with the underside of the rim on the bottle. This enables the gripper assembly to engage the bottle and pick it up as the cross head of the assembly is elevated prior to horizontal transport.

The cap and the cylinder together may be considered as being in the form of an inverted cup and are biased downwardly by the spring 58 compressed between the top of the cap and the underside of shoulder 60. The long spring 62 is compressed between the top of the cap and the underside of support 20. This spring will be compressed if the gripper assembly strikes the top of a bottle at such an angle that it cannot accommodate the misalignment, at which time the entire gripper moves upwardly relative to support 20 while compressing spring 62. It will be noted that when the stem and gripper are so lifted, spring 58 is not compressed. When pressure is introduced to chamber 44, spring 58 is compressed as the cap moves upwardly relative to the stem. Obviously spring 62 will also be compressed but this is a relatively low force. Spring 58 acts as the return spring moving the cap and cylinder downwardly when the pressure in chamber 44 is relieved.

Figure 3:
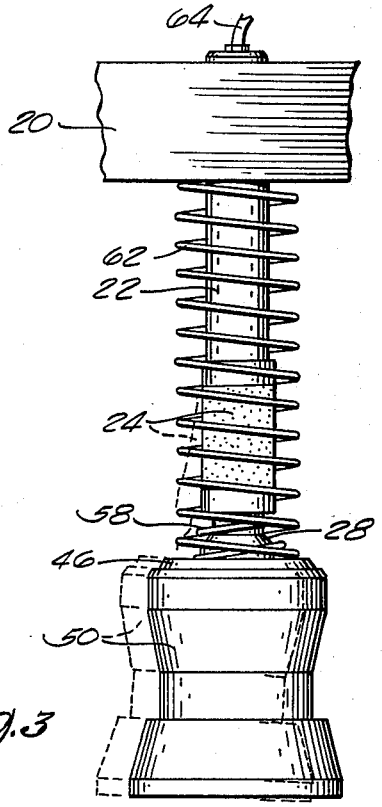
FIG. 3 is a view showing the manner in which the stem in the present construction can flex.
Figure 2:
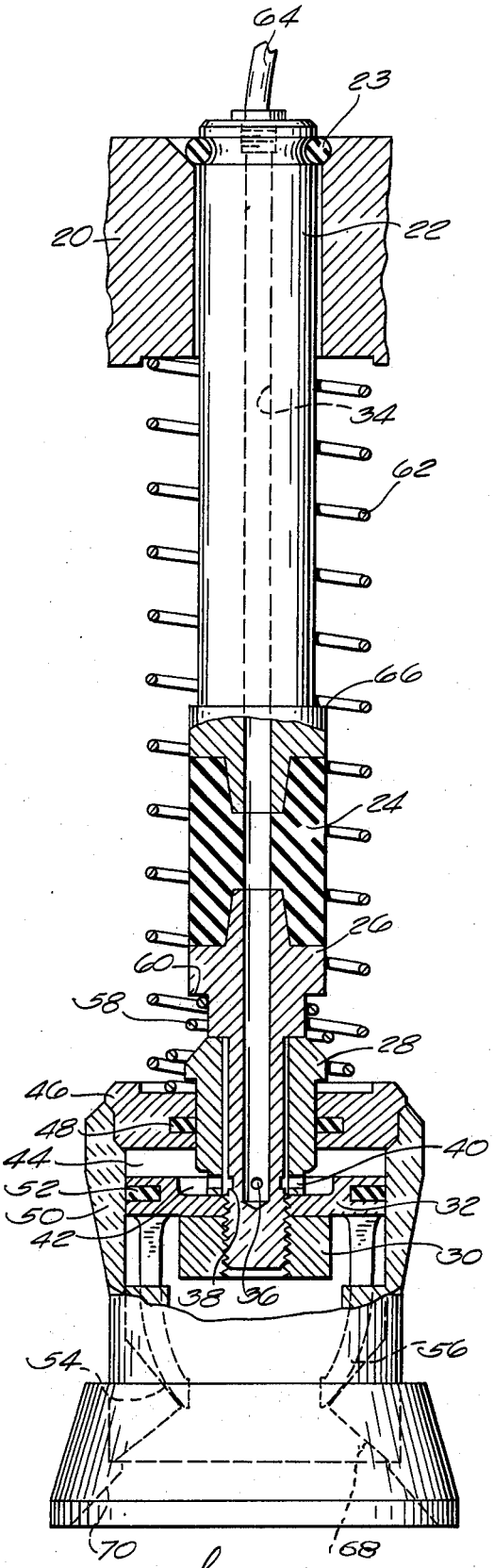
FIG. 2 is a vertical section through a typical gripper according to this invention.

The rubber stem section 24 is made of 70 durometer rubber and it will be noted the flexible section is just that portion between the facing tapered ends of stem sections 22, 26. In one design the ends are spaced 19 mm with an outside diameter of the rubber of 25 mm and a rubber wall thickness of 10 mm. This flexible section is adequate to permit the gripper to move within a limited range to accommodate misalignment with the bottle as illustrated in FIG. 3. But the section is sufficiently stiff to resist the tendency to swing or pendulate as the assembly is moved horizontally between its two positions. Therefore, the bottles will not bang together and breakage is eliminated while permitting the cycle time of the gripper assembly to be decreased substantially, thus increasing the production of the machine.

All surfaces of the upper and lower stems contacted by the rubber should be etched or sandblasted before applying the adhesive and the rubber section. It has been found that when properly prepared this assembly is extremely durable and the flexibility is useful in accommodating misalignment while preventing the breakage inherent in the prior art flexible stems. The short flexible section does not become so limp in use as to become prone to the pendulation problem. And this adaptation to misalignment retains provision for vertical movement since air pressure is applied to the bore of the stem through the flexible hose 64 which accommodates any necessary vertical movement of the stem. The upward movement of the stem is limited by engagement of shoulder 66 with the underside of support member 20.

Not all misalignment requires flexure of the stem since the lower inside of the member 50 has an internal flare 68 and a separate internally flared collar 70 is mounted on the member to enlarge the entry area. When the bottle hits at an extreme position, the stem will flex but slight misalignment is accommodated by the flare alone.

I claim:

1. A gripper assembly comprising, a frame, a support member mounted in the frame for vertical and horizontal movement, a stem mounted in the support member for vertical motion relative to the support member and provided with means limiting the downward movement of the stem, a gripper head on the lower end of the stem, a spring biasing the stem downwardly, means mounted in the gripper head for engaging the neck of a bottle, means for actuating the last named means, said stem including a relatively short section of limited flexibility permitting the gripper head to be deflected laterally to accommodate misalignment of the gripper head with a bottle, said flexible section being sufficiently stiff to prevent appreciable swinging or pendulation of the bottle during rapid horizontal movement of the gripper head.

2. An assembly according to claim 1 in which said stem includes upper and lower rigid sections joined by said short flexible section and the upper section is slidable in said support member.

3. An assembly according to claim 2 in which the gripper head is mounted on the lower stem section for limited axial movement relative thereto, and a second spring compressed between the head and the lower section urging the head to its lowermost position.

* * * * *